US005633124A

United States Patent [19]

Schmittou et al.

[11] Patent Number: 5,633,124

[45] Date of Patent: May 27, 1997

[54] ACCELERATION OF SILVER REMOVAL BY THIOETHER COMPOUNDS

[75] Inventors: Eric R. Schmittou, Rochester; Jacob J. Hastreiter, Jr., Spencerport; Stuart T. Gordon, Pittsford, all of N.Y.

[73] Assignee: Eastman Kodak Company, Rochester, N.Y.

[21] Appl. No.: 326,558

[22] Filed: Oct. 20, 1994

Related U.S. Application Data

[63] Continuation of Ser. No. 880,423, May 8, 1992, abandoned.

[51] Int. Cl.[6] ..... G03C 11/00; G03C 5/18; G03C 5/26; G03C 5/38

[52] U.S. Cl. ..... 430/372; 430/393; 430/428; 430/429; 430/455; 430/459; 430/460

[58] Field of Search ..... 430/372, 393, 430/428, 429, 455, 459, 460

[56] References Cited

U.S. PATENT DOCUMENTS

| | | | |
|---|---|---|---|
| H953 | 8/1991 | Goto et al. | 430/393 |
| 2,748,000 | 5/1956 | Mader | 95/88 |
| 3,201,242 | 8/1965 | Schwan et al. | 96/55 |
| 3,241,966 | 3/1966 | Heilmann et al. | 96/60 |
| 3,615,507 | 10/1971 | Bard et al. | 96/60 |
| 3,767,401 | 10/1973 | Newman et al. | 96/50 A |
| 3,961,958 | 6/1976 | Schellenberg | 430/429 |
| 4,126,459 | 11/1978 | Greenwald | 96/29 R |
| 4,201,585 | 5/1980 | Pollet et al. | 430/376 |
| 4,267,256 | 5/1981 | Bloom et al. | 430/251 |
| 4,525,449 | 6/1985 | Nakajima et al. | 430/407 |
| 4,695,529 | 9/1987 | Abe et al. | 430/351 |
| 4,797,352 | 1/1989 | Koboshi et al. | 430/428 |
| 4,804,618 | 2/1989 | Ueda et al. | 430/393 |
| 4,908,300 | 3/1990 | Koboshi et al. | 430/393 |
| 4,914,009 | 4/1990 | Ueda et al. | 430/378 |
| 4,954,426 | 9/1990 | Ishikawa | 430/386 |
| 4,960,683 | 10/1990 | Okazaki et al. | 430/428 |
| 4,965,176 | 10/1990 | Ishikawa et al. | 430/378 |
| 4,983,503 | 1/1991 | Ishikawa et al. | 430/393 |
| 5,002,859 | 3/1991 | Kuse et al. | 430/393 |
| 5,002,860 | 3/1991 | Ishikawa et al. | 430/393 |
| 5,002,861 | 3/1991 | Nakazyo et al. | 430/393 |
| 5,004,677 | 4/1991 | Ueda | 430/382 |
| 5,011,763 | 4/1991 | Morimoto et al. | 430/393 |
| 5,043,253 | 8/1991 | Ishikawa | 430/393 |
| 5,068,170 | 11/1991 | Abe | 430/393 |
| 5,093,228 | 3/1992 | Nakamura | 430/393 |
| 5,102,778 | 4/1992 | Nakamura | 430/393 |

FOREIGN PATENT DOCUMENTS

| | | |
|---|---|---|
| 1281580 | 3/1991 | Canada . |
| 428101 | 5/1991 | European Pat. Off. . |
| 63/281163 | 11/1988 | Japan . |
| 1020032 | 2/1966 | United Kingdom . |

*Primary Examiner*—Glenn A. Caldarola
*Assistant Examiner*—J. Pasterczyk
*Attorney, Agent, or Firm*—Sarah Meeks Roberts; J. Lanny Tucker

[57] ABSTRACT

This invention provides a process for removal of silver halide from a silver halide photographic recording material by a processing solution with fixing ability (a fixer) containing thiosulfate as a fixing agent conducted in the presence of a thioether compound incorporated within a fixer formulation. It further provides a fixer formulation for use in said process. The fixer contains a maximum ammonium ion concentration of 0.9M.

21 Claims, No Drawings

ACCELERATION OF SILVER REMOVAL BY THIOETHER COMPOUNDS

This is a Continuation of application U.S. Ser. No. 880,423, filed 8 May 1992, now abandoned.

FIELD OF THE INVENTION

This invention relates to the processing of silver halide photographic recording materials. More specifically, it relates to the fixing of silver halide photographic recording materials using an aqueous solution containing thiosulfate as a fixing agent.

BACKGROUND OF THE INVENTION

The basic image-forming process of silver halide photography comprises the exposure of a silver halide photographic recording material to actinic radiation (for example, light or X-rays), and the manifestation of a usable image by the wet, chemical processing of the material. The fundamental steps of this processing entail, first, treatment of the recording material with one or more developing agents wherein some of the silver halide is reduced to metallic silver. With black-and-white photographic materials, the metallic silver usually comprises the desired image. With color photographic materials, the useful image consists of one or more images in organic dyes produced from an oxidized developing agent formed where silver halide is reduced to metallic silver.

To obtain useful black-and-white images it is usually desirable to remove the undeveloped silver halide, and to obtain useful color images it is usually desirable to remove all of the silver from the photographic element after the image has been formed. In black-and-white photography the removal of undeveloped silver halide is accomplished by dissolving it with a silver halide solvent, commonly referred to as a fixing agent. In color photography the removal of silver is generally accomplishedby oxidizing the metallic silver, and dissolving the oxidized metallic silver and undeveloped silver halide with a fixing agent. The oxidation of metallic silver is achieved with an oxidizing agent, commonly referred to as a bleaching agent. The dissolution of oxidized silver and undeveloped silver halide can be accomplished concurrently with the bleaching operation in a bleach-fix process using a bleach-fix solution, or subsequent to the bleaching operation by using a separate processing solution containing a fixing agent.

It is highly desirable to process a photographic recording material as rapidly as feasible, and an accelerated process—a shortened process compared to ones known in the art—is highly desired. In particular, shortening the silver removal step, which consumes a large amount of the total process time, is an attractive manner in which to shorten the overall processing time. Juxtaposed to the desire for an accelerated process is the desire for, and the need for, photographic recording materials and processing solutions that require lower chemical usage and that generate less polluting chemical waste.

A common approach to faster processing is to desilver the photographic material with a single processing solution that accomplishes both the bleaching of silver and the fixing of silver halide. Such a solution is called a bleach-fix bath. These solutions can be useful for processing color paper materials, but they can produce poor bleaching results when color negative films or color reversal films are processed with them. Additionally bleach-fix baths cannot be recycled as efficiently because the bleaching agent in the bleach-fix bath makes it difficult to electrolytically remove silver from the bath.

A wide variety of fixing agents and silver solvents are known. Such materials form relatively stable and soluble reaction products with silver ion or silver halides. Such agents include, for example, alkali metal and ammonium thiosulfates, thiocyanate salts, sulfites, cyanides, ammonia and other amines, imides as described in U.S. Pat. No. 2,857,274, thiols as described in U.S. Pat. Nos. 3,772,020 and 3,959,362, mesoionic 1,2,4-triazolium-3-thiolates as described in U.S. Pat. No. 4,378,424 and other mesoionic heterocyclic thiolates as described in European Patent Application 431,568, thioureas, thioacids, and thioethers as described in German Offen. 2,037,684 and U.S. Pat. Nos. 2,748,000; 3,033,765; 3,615,507; 3,958,992; 4,126,459; 4,211,559; 4,211,562; 4,251,617; and 4,267,256, phosphines as described in U.S. Pat. No. 3,954,473, and concentrated halide solutions as described in U.S. Pat. No. 2,353,661.

Thiosulfate salts are generally preferred as fixing agents because they are inexpensive, highly water soluble, non-toxic, non-odorous, and stable over a wide pH range in the fixer bath. Furthermore, thiosulfate salts form very stable, water soluble reaction products with both silver ion and with silver halides.

Fixer baths containing ammonium thiosulfate are more active and fix silver halide in a photographic recording material more rapidly than thiosulfate salts of other cations, such as sodium thiosulfate or potassium thiosulfate. Adding ammonium salts to sodium thiosulfate fixer baths increases the rate of fixing. Thus, owing to its rapid fixing action, ammonium thiosulfate is widely used as a photographic fixing agent. Ammonium ion (hereinafter sometimes referred to as "ammonium") is, however, a potentially environmentally detrimental chemical. Therefore it is desirable to produce a fixing bath that has lower concentrations of ammonium, or that has no ammonium whatsoever, in order to reduce or completely eliminate its contribution to photographic effluent pollution.

Reducing the concentration of ammonium ion in the fixer bath in order to reduce pollution will result in longer fixing times for films. Fixing times could be made shorter by using a more concentrated solution of thiosulfate salt, but this increases the chemical waste and the economic cost of the process. In order to minimize wastes, it is desirable to use fixer baths with as low a concentration of fixing agent as is practicable. Since lowering the concentration of fixing agent has the disadvantage of making fixing times and overall processing times longer, there is a need for materials that can accelerate the fixing process when added to fixing solutions that contain only low concentrations of ammonium ion, or no ammonium ion at all.

It is appreciated in the art that photographic recording materials containing silver iodide and silver iodide-containing emulsions are fixed more slowly than silver bromide, silver chloride, or silver chlorobromide emulsions. Thus, there is a need for materials and methods that can increase the fixing speed of photographic recording materials containing silver iodide and silver iodide-containing emulsions, in particular.

Furthermore, it is recognized that iodide dissolved in the fixer solution also slows the rate of fixing of a silver halide photographic material. Thus, there is a need for materials and methods that can increase the fixing speed of photographic recording materials in the presence of iodide dissolved in the fixer bath.

One approach to improve photographic recording material fixability is to employ fixing accelerating agents in the fixer bath. Numerous compounds which promote or increase the rate of fixing are known which can be added to the fixing bath. Examples of such fixing promoters are described in Chapter 15 of "The Theory of the Photographic Process", 4th Edition, T. H. James, ed., Macmillan, New York, 1977. Such substances include ammonium salts, such as ammonium chloride, ethylenediamine, guanidine, and other amines as described by E. Elvegard, *Photographische Industrie,* 40, 249 (1942). Other amine salts and quaternary ammonium salts such as pyridinium and piperidinium salts have been reported to accelerate fixing (M. Abribat and J. Pouradier, Science and Applications of Photography (Proc. Intern. Centenary Conf., London, 1953), R. S. Schultze, ed., Royal Photographic Society, London, 1955, pp. 177–180). Thiourea has also been reported to accelerate the fixation of iodide-containing emulsions by sodium thiosulfate (J. Rzymkowski, *Photographische Industrie,* 1251 (1926)). However, all of these compounds have potential enviromental problems.

Thioether compounds have been reported to improve bleaching effectiveness when present in bleach or bleach-fixing baths (for example, British Patent 933,008, U.S. Pat. Nos. 3,241,966; 3,767,401; 4,201,585; 4,695,529; 4,804,618; 4,908,300; 4,914,009; 4,965,176; and 5,011,763, and unexamined Japanese Patent Application JP 02-44,355 A). These references do not disclose the use of thioethers as fix accelerators.

U.S. Pat. No. 4,960,683 of Okazaki et al describes a method for processing black-and-white photosensitive materials comprising fixing a developed black-and-white spectrally sensitized photographic material in the presence of an aliphatic thioether compound and/or a heterocyclic thiol or thiolate compound. The most preferred fixing agent is ammonium thiosulfate. The object of U.S. Pat. No. 4,960,683 is to lessen, and thereby improve, sensitizing dye stain in black-and-white materials.

U.S. Pat. No. 4,960,683 does not show that accelerated desilvering (fixing) results from the inclusion of the thioether compounds in the fixing bath. Indeed, many of the heterocyclic thiol or thiolate compounds described can, in fact, slow or inhibit desilvering. Nor is there any indication that such compounds are useful with a low ammonium thiosulfate fixing solution.

The use of ammonium thiocyanate, thiourea, or a thioether (e.g. 3,6-dithia-1,8-octanediol) to accelerate fixing by ammonium thiosulfate is mentioned in U.S. Pat. No. 5,002,861. However, as shown in this invention, acceleration of fixing by ammonium thiosulfate cannot be accomplished unless certain conditions are met. There is no indication that these compounds are useful with other thiosulfate fixing agents. Additionally, there is a need for reducing the use of ammonium ion in photographic processing solutions.

SIR H953 describes a method of processing color photographic materials in which thioether-containing compounds are present in a fixer bath which immediately follows a bleaching bath containing ammonium 1,3-diaminopropanetetraacetatoferrate(III) as the bleaching agent. The reported result of such a process is the improved bleaching of the developed silver in the photographic material. The fixing bath in this method is really a bleach-fixing bath, in which a significant amount of metallic silver bleaching occurs by the bleaching agent that is carried by the photographic material into the fixing solution during processing, and which accumulates there during continuous processing. This reference does not disclose or anticipate any improvements in the dissolution and removal of silver halide from the photographic material.

There remains a need for materials or methods that increase the speed of fixing of photographic recording materials specifically when iodide is present in the fixing solution. There remains a need for materials or methods that increase the speed of fixing of photographic recording materials specifically containing one or more iodide-containing emulsions. There remains a need for materials or methods that increase the speed of fixing of fixer baths that contain low concentrations of ammonium ion, or that contain no ammonium ion at all, so that improved processing ecology can be achieved.

SUMMARY OF THE INVENTION

This invention provides a process for fixing an exposed and developed silver halide-based color photographic material, the process comprising fixing the material with a fixer comprising thiosulfate and a fix rate-accelerating amount of a thioether, the process being characterized by being conducted:

(a) in the presence of a fix rate-retarding amount of iodide, and (b) in the substantial absence of an iron chelate bleaching agent.

In one embodiment of the invention, the iodide can be present in the fixer in an amount within the range of from about 0.001 to about 0.05M. Alternatively, (i) the iodide is present in at least one iodide-containing silver halide emulsion in the photographic material, in an amount equal to or greater than about 1.0 mole percent iodide, based on the amount of silver in the emulsion, and (ii) the ammonium concentration in the fixer is less than about 1.35 mole per liter.

In another aspect of this invention, the processes described above are applied to exposed and developed silver halide-based non-spectrally sensitized black-and-white photographic materials.

This invention further provides fixer formulations comprising a mixture of a thiosulfate and a thioether.

DETAILED DESCRIPTION OF THE INVENTION

While it has been mentioned in the art that fixing solutions can comprise mixtures of known fixing agents, such as thiosulfates, thiourea, thioether compounds, the fixing rate improvements of this invention are unexpected. The improvements in silver removal rates observed with this invention are greater than expected based on the fixing ability of the thiosulfate fixer in the absence of the thioether compound and the fixing ability of the thioether compound alone. Furthermore, the improvements in silver removal rates are surprisingly found to occur under the specified conditions herein.

The fixer employed in this invention comprises a thioether; that is, a compound having at least one bivalent sulfur atom in which the two sulfur valences are satisfied by bonding to two different carbon atoms. The bivalent sulfur atom is not incorporated in an aromatic ring, i.e. a ring such as the thiophene or 1,3-thiazole ring.

The thioether compounds useful in this invention can be monomeric or polymeric. Monomeric thioether compounds useful in this invention can be described by General Formula (I):

$$R_1SR_2 \quad (I)$$

where $R_1$, and $R_2$, which may be the same or different, represent substituted or unsubstituted hydrocarbon groups having 1 to about 30 carbon atoms. The sulfur atom of (I) is attached to carbon atoms of $R_1$ and $R_2$. The hydrocarbon groups represented by $R_1$ and $R_2$ include saturated or unsaturated, aliphatic or aromatic, straight-chain or branched-chain groups. The groups can contain only carbon atoms or they may contain one or more nitrogen, oxygen, phosphorous, sulfur, or halogen atoms. For example, the groups can contain one or more amino groups; quaternary ammonium groups; imino groups; carbonyl groups; ether groups; thioether groups; carboxylic, sulfuric, or phosphoric acid amide groups; ureido groups; carbamato groups; sulfonyl groups; sulfone groups; and carboxylic, sulfuric, and phosphoric acid ester groups that link together carbon-containing parts of $R_1$, and $R_2$.

The hydrocarbon groups $R_1$ and $R_2$ can be linked together by a bond other than the thioether group of General Formula (I), thereby forming a ring compound. The ring containing the sulfur in formula (I) should not be aromatic; in other words it should not have appreciable aromatic character such as illustrated by thiophene and 1,3-thiazole.

The hydrocarbon groups $R_1$ and $R_2$ each may contain saturated, unsaturated, or aromatic ring groups, which may be heterocyclic. Examples of aromatic ring groups include benzene and naphthalene groups. Examples of heterocyclic groups include pyridine and pyridinium, pyrimidine, pyridazine, pyrazine and pyrazinium, morpholine and morpholinium, piperazine and piperazinium, piperidine and piperidinium, pyrazole and pyrazolium, indole and 3H-indolium, benzindole and benz[e]indolium, oxazole and oxazolium, benzoxazole and benzoxazolium, naphthoxazole and naphthoxazolium, naphthothiazole and naphthothiazolium, thiazoline and thiazolinium, imidazole and imidazolium, thiazole and thiazolium, triazole and triazolium, thiadiazole and thiadiazolium, tetrazole and tetrazolium groups, quinoline and quinolinium, isoquinoline and isoquinolinium, benzimidazole and benzimidazolium, benzothiazole and benzothiazolium, benztriazole and benztriazolium, quinoxaline and quinoxalinium, phenazine and phenazinium, groups, for example.

The hydrocarbon groups $R_1$ and $R_2$ may include one or more substituents including amino groups, guanidino groups, quaternary ammonium groups, hydroxyl groups, halides, carboxylic acid or carboxylate groups, amide groups, sulfinic acid groups, sulfonic acid groups, sulfate groups, phosphonic acid groups, phosphate groups, nitro groups, and cyano groups, for example.

Preferred monomeric thioether compounds for this invention are:

1) compounds described by General Formula (I) in which one or both of $R_1$, and $R_2$ contain guanidine groups or guanidinium groups, or amine groups or ammonium groups, including heterocyclic amine groups and heterocyclic ammonium groups such as pyridine and pyridinium groups; or 2) thioether compounds described by General Formula (II):

$$R_1SR_3SR_2 \qquad \text{(II)}$$

where $R_1$ and $R_2$ are the same as above, and $R_3$ is a divalent group that separates the two thioether sulfur atoms in (II) by two carbon atoms. The group $R_3$ may be, for example, a substituted or unsubstituted ethylene group, including oxalyl and ketenyl groups; a substituted or unsubstituted 1,2-ethenyl group; an ethynyl group; a substituted or unsubstituted 1,2-benzenyl group; a substituted or unsubstituted 1,2- or 2,3-naphthalenyl group; a substituted or unsubstituted 2,3-, or 3,4-pyridinyl group, quinolinyl group, or piperidinyl group; a substituted or unsubstituted 2,3-pyrazinyl group, piperazinyl group, or quinoxalinyl group. $R_3$ may have up to about 10 carbon atoms. Furthermore $R_3$ may be substituted as $R_1$ and $R_2$, as described above.

It is within the scope of this invention to use combinations of two or more thioether compounds to accelerate fixing rates, if desired.

Examples of thioether compounds useful in the present invention include, but are not limited to the following:

| | |
|---|---|
| $CH_3SCH_2CH_2OH$ | 1 |
| $HOCH_2CH_2SCH_2CH_2OH$ | 2 |
| $HOCH_2CH_2SCH_2CH_2SCH_2CH_2OH$ | 3 |
| $HOCH_2CH_2SCH_2CH_2SCH_2CH_2SCH_2CH_2OH$ | 4 |
| $HOCH_2CH_2SCH_2CH_2OCH_2CH_2OCH_2CH_2SCH_2CH_2OH$ | 5 |
| $HOCH_2CH_2OCH_2CH_2SCH_2CH_2SCH_2CH_2OCH_2CH_2OH$ | 6 |
| 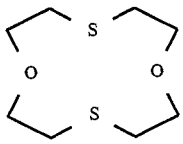 | 7 |
| 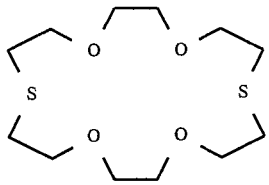 | 8 |
| $CH_3SCH_2CH_2CO_2H$ | 9 |
| $HO_2CCH_2SCH_2CO_2H$ | 10 |
| $HO_2CCH_2CH_2SCH_2CH_2CO_2H$ | 11 |
| $HO_2CCH_2SCH_2CH_2SCH_2CO_2H$ | 12 |
| $HO_2CCH_2SCH_2CH_2SCH_2CH_2SCH_2CH_2SCH_2CO_2H$ | 13 |
| $HO_2CCH_2CH_2SCH_2CH_2SCH_2CH(OH)CH_2SCH_2CH_2SCH_2CH_2CO_2H$ | 14 |
| $HO_2CCH_2CH_2SCH_2CH_2SCH_2CH(OH)CH(OH)CH_2SCH_2CH_2SCH_2CH_2CO_2H$ | 15 |

-continued

| | |
|---|---|
| $CH_3SCH_2CH_2CH_2NH_2$ | 16 |
| $H_2NCH_2CH_2SCH_2CH_2NH_2$ | 17 |
| $H_2NCH_2CH_2SCH_2CH_2SCH_2CH_2NH_2$ | 18 |
| $H_2NCH_2CH_2OCH_2CH_2SCH_2CH_2SCH_2CH_2OCH_2CH_2NH_2$ | 19 |
| $H_2NCH_2CH_2SCH_2CH_2OCH_2CH_2OCH_2CH_2SCH_2CH_2NH_2$ | 20 |
| $H_2NCH_2CH_2SCH_2CH_2SCH_2CH_2SCH_2CH_2SCH_2CH_2NH_2$ | 21 |

22

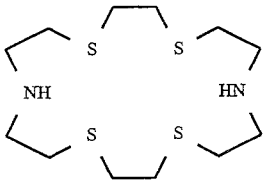

23

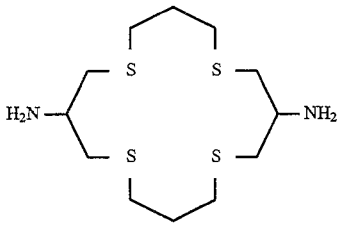

| | |
|---|---|
| $CH_3SCH_2CH_2CH(NH_2)CO_2H$ | 24 |
| $HO_2C(NH_2)CHCH_2CH_2SCH_2CH_2SCH_2CH_2CH(NH_2)CO_2H$ | 25 |
| $HO_2C(NH_2)CHCH_2SCH_2CH_2OCH_2CH_2OCH_2CH_2SCH_2CH(NH_2)CO_2H$ | 26 |
| $HO_2C(NH_2)CHCH_2OCH_2CH_2SCH_2CH_2SCH_2CH_2OCH_2CH(NH_2)CO_2H$ | 27 |
| $H_2N(O)CCH_2SCH_2CH_2OCH_2CH_2OCH_2CH_2SCH_2C(O)NH_2$ | 28 |
| $H_2N(O)CCH_2SCH_2CH_2SCH_2C(O)NH_2$ | 29 |
| $H_2NHN(O)CCH_2SCH_2CH_2SCH_2C(O)NHNH_2$ | 30 |
| $CH_3C(O)NHCH_2CH_2SCH_2CH_2SCH_2CH_2NHC(O)CH_3$ | 31 |
| $H_2NO2SCH_2CH_2SCH_2CH_2SCH_2CH_2SO_2NH_2$ | 32 |
| $NaO_3SCH_2CH_2CH_2SCH_2CH_2SCH_2CH_2CH_2SO_3Na$ | 33 |
| $CH_3SO_2NHCH_2CH_2SCH_2CH_2SCH_2CH_2NHO_2SCH_3$ | 34 |
| $H_2N(NH)CSCH_2CH_2SC(NH)NH_2.2HBr$ | 35 |
| $H_2N(NH)CSCH_2CH_2OCH_2CH_2OCH_2CH_2SC(NH)NH_2.2HCl$ | 36 |
| $H_2N(NH)CNHCH_2CH_2SCH_2CH_2SCH_2CH_2NHC(NH)NH_2$-2HBr | 37 |
| $[(CH_3)_3NCH_2CH_2SCH_2CH_2SCH_2CH_2N(CH_3)_3]^{2+}\ 2Cl^-$ | 38 |

39

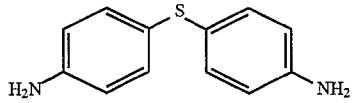

40

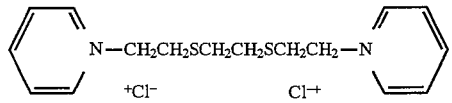

41

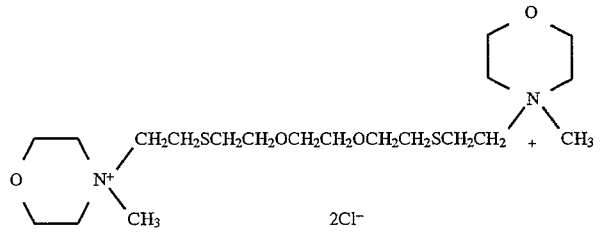

42

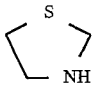

43

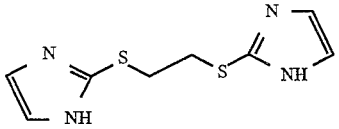

-continued
44
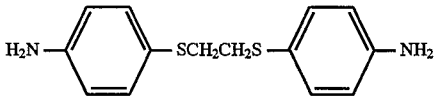
45
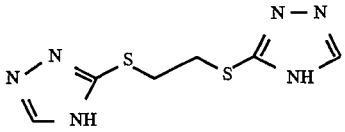
46
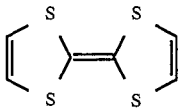
47
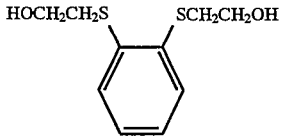
48
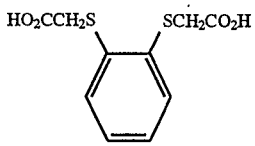
49
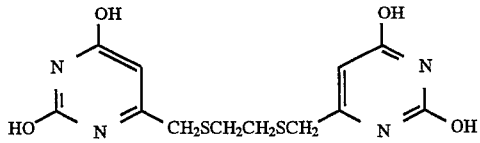
50
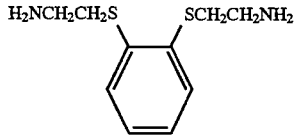
51
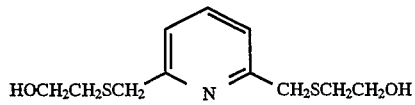
52
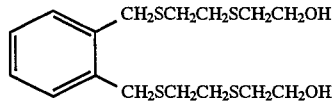
53
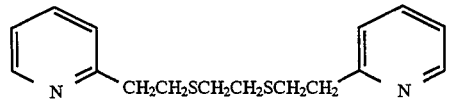
54
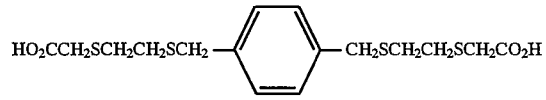
55
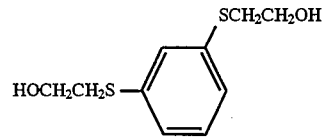
56
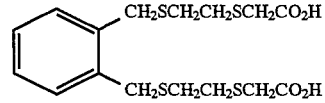

-continued

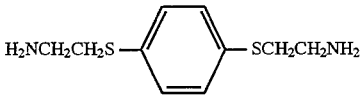

57

Preferred thioethers for use in this invention are compounds 3, 8, 16, 18, 19, 22, 23, 37, 40, 41 and 43.

Polymeric thioether compounds useful in the present invention can be described by General Formula (III):

General Formula (III) is:

$$(R_4SR_5)_x \quad \text{(III)}$$

in which $R_4$ and $R_5$ represent alkylene groups and x is greater than or equal to 3. The alkylene groups $R_4$ and $R_5$ represent hydrocarbon groups having 1 to about 20 carbon atoms. The hydrocarbon groups represented by $R_4$ and $R_5$ include saturated or unsaturated, aliphatic or aromatic, straight-chain or branched-chain groups. The groups can contain only carbon atoms or they can contain one or more nitrogen, oxygen, phosphorous, sulfur, or halogen atoms. For example, the groups can contain one or more amino groups; quaternary ammonium groups; imino groups; carbonyl groups; ether groups; thioether groups; carboxylic, sulfuric, or phosphoric acid amide groups; ureido groups; carbamato groups; sulfonyl groups; sulfone groups; and carboxylic, sulfuric, and phosphoric acid ester groups that link together carbon-containing parts of $R_4$ and $R_5$.

The alkylene groups of these polymeric thioether compounds can be terminated by hydrogen atoms; alkenyl groups; amino groups; hydroxyl groups; carboxylic acid, ester, or amide groups; thiol groups; halides; or combinations of these groups.

Examples of this type of polymeric thioether compound are described in U.S. Pat. Nos. 3,046,129; 3,046,132; and 3,574,628.

Useful thioether-containing polymers can have thioether groups in the side-chain substituents of the polymer instead of, or in addition to, thioether groups in the polymer chain itself. Examples of this kind of polymer are described in U.S. Pat. Nos. 3,046,133 and 4,013,471.

Additional examples of thioether compounds useful in the present invention are the thioether substituted silver halide solvents, fixing agents, emulsion sensitizers, and development accelerators described in U.S. Pat. Nos. 2,521,926; 3,033,765; 3,038,805; 3,057,724; 3,062,646;.3,201,242; 3,271,157; 3,506,443; 3,574,628; 3,574,709; 3,622,329; 3,625,697; 3,958,992; 4,057,429; 4,126,459; 4,211,559; 4,211,562; 4,251,617; 4,267,256; 4,695,534; 4,695,535; 4,713,322; and 4,782,013; in Canadian Patent 1,281,580; in British Patent 1,510,651; and in European Patent Application No. 216,973; the thioether-containing dicarboxylic acids described in U.S. Pat. No. 2,748,000; the thioether-containing organic diols described in U.S. Pat. Nos. 3,021,215 and 3,615,507; the thioether-containing polyalkylene oxide compounds described in U.S. Pat. Nos. 3,241,966 and 4,201,585; the thioether-containing bleaching accelerators described in U.S. Pat. Nos. 4,695,529; 4,908,300; 4,914,009; and 5,002,860; the thioether-containing metal chelating compounds described in U.S. Pat. No. 4,804,618 and their metal complexes; the thioether-containing compounds described in U.S. Pat. No. 4,960,683 and European Patent Application No. 458,277, and the amine-containing thioether compounds described in U.S. Pat. No. 5,011,763.

The thioether compound of this invention contacts the silver halide grains during the fixing of the silver halide by the thiosulfate fixing agent. This is accomplished by dissolving the thioether compound in the fixing solution. The thioether compound should be soluble in the aqueous fixing solution.

The thioether compound must be used in an amount such that the rate of fixing with the thioether/thiosulfate fixer is greater than the sum of the rates achieved when said thiosulfate or thioether are each used alone.

The concentration of thioether compound in the fixing solution should be from about $1\times10^{-4}$ molar to about $5\times10^{-1}$ molar, more preferably from about $1\times10^{-3}$ molar to about $2\times10^{-1}$ molar; most preferably $1\times10^{-2}$ molar to $2\times10^{-1}$ molar. With polymeric thioether compounds and thioether compounds with molecular weights greater than about 500, the above concentration range is meant to apply to the concentration of thioether groups rather than to the concentration of the thioether-containing compound itself.

The advantages of this invention are realized under two specific circumstances:

I) by fixing a silver halide photographic recording material with a fixing bath that 1) provides one or more of the above-described thioether compounds and a thiosulfate as a fixing agent, and 2) contains iodide at a fix rate retarding concentration, which is generally greater than or equal to about $1\times10^{-3}$ molar. Preferably the iodide is present in the fixer in an amount of from about $1\times10^{-3}$ molar to $5\times10^{-2}$ molar.

II) by fixing a silver halide photographic recording material with a fixing formulation (bath) having one or more of the above-described thioether compounds and which also 1) contains thiosulfate as a fixing agent and 2) contains less than about 1.35 molar ammonium ion, the recording material comprising at least one silver halide emulsion to be fixed with an iodide content greater than or equal to about 1.0 mole percent based on silver content. In the most preferred embodiment there is no ammonium present in the fixing solution.

The iodide-containing emulsion can be a coarse, regular, or fine grain emulsion. It can consist of grains of silver bromoiodide, silver chloroiodide, or silver chlorobromiodide. It can optionally be chemically and spectrally sensitized. It can have any crystal habit, such as cubic, octahedral, spherical, tabular, and double-structure. It can be monodisperse or polydisperse. The iodide can be uniformly distributed through silver halide grain, or it can vary continuously or discontinuously across the diameter of the grain, as in core-shell or multiple structure grains.

It should be understood that the fixing solutions of this invention are fixing solutions intended for the rapid and efficient removal of silver halide from photographic material, and not bleach-fixer solutions which, in contrast, are used not only to remove silver halide from photographic materials, but also to oxidize and remove a significant amount of the developed metallic silver from photographic materials. Thus, for the purpose of this invention, there is no, or substantially no, bleach agent (such as an iron chelate) in the fixer formulation. "Substantially no" means that the only bleaching agent input, if any, into the fixer solution is that which is carried into the fixer solution by the photographic material. In other words, there is no other significant input of bleaching agent into the fixer solution, such as, for example, introducing bleaching agent overflow solution into the fixer tank.

If the fixing solution is utilized before the bleaching bath it will contain no bleaching agent and will perform no bleaching function. If the fixing solution is utilized after a bleaching solution the photographic element will already be substantially bleached. That is that any unbleached silver remaining in the photographic material after treatment with a processing solution having a bleaching ability will be less than about 0.1 g/sq. meter, more preferably less than 0.05 g/sq. meter, and most preferably less than 0.03 g/sq. meter.

The thiosulfate may be provided by ammonium thiosulfate, sodium thiosulfate, potassium thiosulfate, lithium thiosulfate, magnesium thiosulfate, or calcium thiosulfate, or mixtures of these thiosulfates, such that the desired content of thiosulfate in the fixer is met. In a preferred embodiment the thiosulfate is sodium thiosulfate. The iodide may be already present in the fixer composition or replenisher composition, or it may be introduced into the fixer solution by a silver halide photographic recording material that is processed with the fixer solution.

The concentration of thiosulfate in the fixing solution can be from about 0.05M to as high as solubility in the processing solution allows, but it is preferred that this concentration be from about 0.1M to 2M. The pH of the fixer bath may range from about 3 to as high as about 12. It is generally preferred that the pH be between 4 and 10, most preferably between about 4 and 8. The fixer bath can optionally contain a source of sulfite or bisulfite ion. If the fixer bath is to be used at a pH below about 7, it is preferred to include a source of sulfite or bisulfite ion in the fixer solution. For example, sodium or potassium sulfite, sodium or potassium bisulfite, or sodium or potassium metabisulfite can be used. The concentration of this source of sulfite or bisulfite ion is generally from about 0.01M to about 0.5M. To control solution pH, various buffering agents may be used in the fixer bath, including the above-mentioned sulfite or bisulfite sources, acetate salts, citrates, tartrates, borates, carbonates, phosphates, etc.

In addition to thiosulfate and sulfite or bisulfite, the fixer bath can contain one or more other compounds known to be fixing agents. Such compounds include thiocyanate salts, thiourea, amines, and imides such as described in Chapter 59 of "Comprehensive Coordination Chemistry", Vol. 6, G. Wilkinson, ed., Pergamon, Oxford, 1987. These compounds are typically used as fixing agents at concentrations and conditions under which the compounds effectively remove silver halide (generally greater than about 0.2M). In contrast, the thioether fix accelerators of this invention are typically used at concentrations and conditions under which the thioether compound is not very effective at removing silver halide (generally less than about 0.2M).

If a film hardening action is desired for the fixer bath, the bath may contain one or more ingredients to effect film hardening and to stabilize the hardening agent in the fixer bath. Such ingredients include potassium alum, aluminum sulfate, aluminum chloride, boric acid, sodium tetraborate, gluconic acid, tartaric acid, citric acid, acetic acid and sodium acetate, for example.

The fixer bath may contain one or more substances which are known to accelerate film fixing. These materials are described in Chapter 15 of "The Theory of the Photographic Process", 4th edition, T. H. James, ed., Macmillan, New York, 1977. Such substances include ammonium salts, such as ammonium chloride (with applicable content restrictions described above), ethylenediamine, and other amines, such as guanidine, and thiourea.

The fixer bath may also contain compounds for the prevention of precipitation of metal salts of metals other than silver, that are initially present in or that become introduced into the fixer bath during use. Such metals include iron, copper, zinc, magnesium, calcium, aluminum, and chromium, among others. Metal sequestering agents, chelating agents, and precipitation control agents may be used to control these metals. Examples of these metal control agents are polycarboxylic acids such as citric acid and tartaric acid; aminocarboxylic acids such as nitrilotriacetic acid, ethylenedinitrilotetraacetic acid (EDTA), and diethylenetriaminepentaacetic acid; organophosphonic acids such as nitrilotris(methylenephosphonic) acid and 1-hydroxyethylidene-1,1-diphosphonic acid; orthodihydroxybenzene compounds such as 4,5-dihydroxy-m-benzenedisulfonic acid; acyclic or cyclic polyphosphates; and various polymers such as polyacrylic acids.

During use the fixer bath will accumulate dissolved silver halide, and other substances such as spectral sensitizing dyes, gelatin, etc. extracted from the photographic material. The dissolved silver and halide can slow the rate of fixing. The concentrations of the fixer bath constituents during processing are determined by the usual controlling factors, namely, fixer replenishment rates and replenishing component concentrations, water losses due to evaporation, evaporative losses of volatile components other than water, the amounts and compositions of processing liquids carried into and out of the fixer bath solution by the photographic recording material, the amount of solution overflow from other vessels containing processing solutions that is introduced into the fixer bath, the amount of solid components carried into the fixer bath by the photographic recording material and then dissolved in the fixer bath, and the rate of removal or replacement of any constituent by means such as ion exchange, electrolysis, electrodialysis, precipitation, evaporation, and the like.

The fixing process can be conducted using a single fixing solution in one processing vessel, or by using more than one fixer solution in more than one processing vessel. In an attempt to effect reductions in replenishment amounts, a multistage countercurrent method of replenishment and fixing solution management is commonly used, using two or more fixing vessels or tanks through which the film is passed. The present invention can be used advantageously in any of these countercurrent or multistage fixing processes, or in any other multistage fixing process known in the art, for example those described in U.S. Pat. No. 4,719,173.

The present invention can be used advantageously with any of the known methods of applying fixing solutions and solutions of silver solvents to photographic recording materials. These methods include, but are not limited to: immersing the recording material into the fixing solution, optionally employing methods of high solution agitation or circulation; bringing the photographic material into contact with a web or drum surface that is wet with the fixer solution; laminating the photographic material with a cover sheet or web in such a way that fixing solution is brought into contact with the photographic material (such methods as described for example in U.S. Pat. Nos. 3,179,517 and 5,009,984); applying the fixer solution to the photographic material by high velocity jet or spraying, and the like.

Since the fixing step is a separate step in the overall image-forming process, any processing sequence for black-and-white or color silver halide photographic recording materials is contemplated by this invention, as long as a fixing step is part of the overall process. Processing sequences and methods are described in *Research Disclosure*, December 1989, Item 308119, and *Research Disclosure*, December 1978, Item 17643. In the processing of black-and-white photographic recording materials the processing sequences typically include a development step preceding a fixing step, which in turn precedes a final washing or stabilizing step. One or more additional processing steps may come before the development, fixing, and final washing or stabilizing steps, such as other washing steps. These may include a prebath and/or washing treatment prior to the development step and a stop bath and/or washing treatment after the development step.

In the processing of color photographic recording materials, the processing sequences typically include one or more color development steps preceding a series of one or more desilvering steps, which comprise bleaching, bleach-fixing, and/or fixing steps. Examples of such processes are Process C-41 and Process ECN-2 for color negative films, Process E-6 and Process K-14 for color reversal films, and Process RA-4 for color papers. The process of this invention must include a fixing step of this invention in the desilvering sequence. Generally it is preferred that a washing or stabilization step follow the last bleach-fixing or fixing step, but this is not required in order to practice the invention. One or more additional processing steps may come before the color development, bleaching, bleach-fixing, fixing, and/or stabilization steps, such as other washing steps. Examples of color photographic process sequences contemplated by the invention include:

color development; bleaching; fixing*; washing or stabilization color development; bleach-fixing; fixing* washing or stabilization color development; fixing* ; bleach-fixing; washing or stabilization color development; fixing*; bleaching; fixing; washing or stabilization color development; fixing; bleaching; fixing*; washing or stabilization color development; fixing*; bleaching; fixing*; washing or stabilization In these process sequences, the fixing step designated with an "*" is a fixing step of this invention. Other examples of modifications to the above processing sequences contemplated by the invention include: sequences comprising a prebath or washing treatment, a black-and-white development step, a stop bath, a chemical fogging step, and one or more color development steps prior to the color development step that precedes the desilvering sequence; a stop bath and/or washing treatment after the color development step that precedes the desilvering sequence; and a bleach accelerator bath and/or washing step before a bleaching step or bleach-fixing step.

Any of the known formulations for the development and image stabilization of black-and-white and color photographic recording materials may be used with the invention. Any of the known formulations for the bleaching and bleach-fixing of developed silver in color photographic recording materials may be used with the invention.

The fixing times employed in this invention are not critical. One may use shorter or longer fixing times, as desired. In instances where longer fixing times are used, generally speaking the ammonium ion content can be reduced, and the environmental advantages provided by this invention optimized. Thus for example, one may use fixing times of 240 seconds, 480 seconds, or even longer. However, it is preferred to use comparatively short fixing times in order to have greater processing throughput. By incorporating the thioether compounds of this invention, it is possible to minimize the fixing time of the process under the prescribed conditions of iodide in the fixer bath or in the silver halide emulsions, and under the prescribed conditions of low ammonium content in the fixer bath. For example, one may conduct the fixing process of this invention in as short a time as about 10 seconds. The preferred fixing time is 10 to 480 seconds.

The photographic elements used with this invention can be single color elements or multicolor elements. Multicolor elements typically contain dye image-forming units sensitive to each of the three primary regions of the visible spectrum. Each unit can be comprised of a single emulsion layer or of multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer, e.g., as by the use of microvessels as described in Whitmore U.S. Pat. No. 4,362,806 issued Dec. 7, 1982. The element can contain additional layers such as filter layers, interlayers, overcoat layers, subbing layers and the like.

In the following discussion of suitable materials for use in the emulsions and elements of this invention, reference will be made to *Research Disclosure*, December 1989, Item 308119, published by Kenneth Mason Publications, Ltd., Dudley Annex, 12a North Street, Emsworth, Hampshire P010 7DQ, ENGLAND, the disclosures of which are incorporated herein by reference. This publication will be identified hereafter by the term "Research Disclosure".

The silver halide emulsions employed in the elements of this invention can be either negative-working or positive-working. Examples of suitable emulsions and their preparation are described in Research Disclosure Sections I and II and the publications cited therein. Some of the suitable vehicles for the emulsion layers and other layers of elements of this invention are described in Research Disclosure Section IX and the publications cited therein.

The silver halide emulsions can be chemically and spectrally sensitized in a variety of ways, examples of which are described in Sections III and IV of the Research Disclosure. The elements of the invention can include various couplers including but not limited to those described in Research Disclosure Section VII, paragraphs D, E, F and G and the publications cited therein. These couplers can be incorporated in the elements and emulsions as described in Research Disclosure Section VII, paragraph C and the publications cited therein.

The photographic elements of this invention or individual layers thereof can contain among other things brighteners (Examples in Research Disclosure Section V), antifoggants and stabilizers (Examples in Research Disclosure Section VI), antistain agents and image dye stabilizers (Examples in Research Disclosure Section VII, paragraphs I and J), light absorbing and scattering materials (Examples in Research Disclosure Section VIII), hardeners (Examples in Research Disclosure Section X), plasticizers and lubricants (Examples in Research Disclosure Section XII), antistatic agents (Examples in Research Disclosure Section XIII), matting agents (Examples in Research Disclosure Section XVI) and development modifiers (Examples in Research Disclosure Section XXI).

The photographic elements can be coated on a variety of supports including but not limited to those described in Research Disclosure Section XVII and the references described therein.

Photographic elements can be exposed to actinic radiation, typically in the visible region of the spectrum, to form a latent image as described in Research Disclosure Section XVIII and then processed to form a visible dye image examples of which are described in Research Disclosure Section XIX. Processing to form a visible dye image includes the step of contacting the element with a color developing agent to reduce developable silver halide and oxidize the color developing agent. Oxidized color developing agent in turn reacts with the coupler to yield a dye.

With negative working silver halide, the processing step described above gives a negative image. To obtain a positive (or reversal) image, this step can be preceded by development with a non-chromogenic developing agent to develop exposed silver halide, but not form dye, and then uniformly fogging the element to render unexposed silver halide developable. Alternatively, a direct positive emulsion can be employed to obtain a positive image.

The following examples are intended to illustrate, without limiting, this invention.

EXAMPLE I

A silver halide color negative film (KODACOLOR GOLD 200 Film), in the form of strips that were 305 mm long and 35 mm wide, was given a suitable exposure to light and then processed by contacting the strips sequentially with processing solutions as follows:

| Process Step | Process Time, sec | Process Temp, °F. | Process Solution Volume, L | Agitation Type[a] |
|---|---|---|---|---|
| Color Development | 195 | 100 | 8 | 1 |
| Bleaching | 240 | 100 | 8 | 2 |
| Water Wash | 180 | 95 | 8 | 3 |
| Fixing | b) | 100 | 8 | 2 |
| Water Wash | 180 | 95 | 8 | 3 |
| Stabilization | 60 | 100 | 8 | 4 |

[a]The type of agitation used in the processing solutions is as follows:
1) the solution was agitated by the intermittent introduction of nitrogen gas bubbles through a perforated flat plate at the bottom of the solution tank. The bubbles were introduced for a 2 second interval once every 10 seconds.
2) the solution was continuously agitated by a constant flow of air bubbles through a perforated flat plate at the bottom of the solution tank.
3) the solution was agitated by the constant flow of fresh water into the bottom of the tank, with the overflow going to a drain.
4) the solution was quiescent, and received no agitation.
b) The film was fixed for varying lengths of time to determine the speed of silver halide removal and the time required for complete fixing of the film in the fixer baths. The film contained 8.092 g/m$^2$ of silver halide to be fixed, and 0.753 g/m$^2$ of iodide (7.9 mole percent based on silver).

a) The type of agitation used in the processing solutions is as follows:
   1) the solution was agitated by the intermittent introduction of nitrogen gas bubbles through a perforated flat plate at the bottom of the solution tank. The bubbles were introduced for a 2 second interval once every 10 seconds.
   2) the solution was continuously agitated by a constant flow of air bubbles through a perforated flat plate at the bottom of the solution tank.
   3) the solution was agitated by the constant flow of fresh water into the bottom of the tank, with the overflow going to a drain.
   4) the solution was quiescent, and received no agitation.

b) The film was fixed for varying lengths of time to determine the speed of silver halide removal and the time required for complete fixing of the film in the fixer baths. The film contained 8.092 g/m$^2$ of silver halide to be fixed, and 0.753 g/m$^2$ of iodide (7.9 mole percent based on silver).

The composition of each processing solution (each is an aqueous solution) is as follows:

| Component | Concentration |
|---|---|
| Color Developer: | |
| Potassium carbonate | 34.30 g/L |
| Potassium bicarbonate | 2.32 g/L |
| Sodium sulfite | 0.38 g/L |
| Sodium metabisulfite | 2.78 g/L |
| Potassium iodide | 1.20 mg/L |
| Sodium bromide | 1.31 g/L |
| Diethylenetriaminepentaacetic acid, pentasodium salt | 3.37 g/L |
| Hydroxylamine sulfate | 2.41 g/L |
| 4-(N-ethyl-N-(2-hydroxyethyl)-amino)-2-methylaniline sulfate | 4.52 g/L |
| pH | 10.0 |
| Bleach: | |
| Ammonium bromide | 50.0 g/L |
| 1,3-Diaminopropanetetraacetic acid | 30.3 g/L |
| Ferric nitrate nonahydrate | 36.4 g/L |
| 28% aqueous ammonia | 35.2 g/L |
| Glacial acetic acid | 26.5 g/L |
| 1,3-Diamino-2-hydroxypropane-N,N,N',N'-tetraacetic acid | 1.0 g/L |
| Ferric ammonium ethylenedinitrilotetra-acetate | 65.6 g/L |
| Ethylenedinitrilotetraacetic acid | 5.2 g/L |
| pH | 5.3 |
| Fixers: | |
| The formulas for the fixer baths are given in Table I below. | |
| Stabilization Solution: | |
| PHOTO-FLO 200 solution (manufactured by Eastman Kodak Company) | 5.0 mL/L |

Seven fixer baths were used, the contents of which are shown in the table below. The thiosulfate fixers 1, 3, 4, 5, 6, and 7 contained 0.825M total thiosulfate and 0.2M total bisulfite/sulfite at pH 6.5. The fixer baths differed in the amounts of ammonium ion that they contained. Fixers 1, 3, 4, and 5 contained no ammonium ion and Fixers 6 and 7 contained 1.8M ammonium ion. Fixer 2 contained only the thioether compound, 3. Fixers 3 and 7 contained the thioether compound 3 in addition to thiosulfate. Fixers 4 and 5 contained the thioether compounds 8 and 13, respectively, in addition to thiosulfate. The fixers contained no iodide at the beginning of processing.

3 $HOCH_2CH_2SCH_2CH_2SCH_2CH_2OH$

8

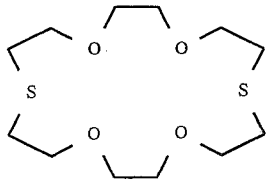

13 $HO_2CCH_2SCH_2CH_2SCH_2CH_2SCH_2CH_2SCH_2CO_2H$

| Fixer | Ammonium Thiosulfate M | Sodium Thiosulfate M | Ammonium Sulfite M | Sodium Sulfite M | Thioether concentration M | Thioether Compound | Ammonium Ion M | pH |
|---|---|---|---|---|---|---|---|---|
| 1 | — | 0.825 | — | 0.2 | — | | 0 | 6.5 |
| 2 | — | — | — | — | 0.01 | 3 | 0 | 6.3 |
| 3 | — | 0.825 | — | 0.2 | 0.01 | 3 | 0 | 6.3 |
| 4 | — | 0.825 | — | 0.2 | 0.001 | 8 | 0 | 6.5 |
| 5 | — | 0.825 | — | 0.2 | 0.01 | 13 | 0 | 6.5 |
| 6 | 0.825 | | 0.075 | 0.125 | — | | 1.8 | 6.3 |
| 7 | 0.825 | | 0.075 | 0.125 | 0.01 | 3 | 1.8 | 6.5 |

After processing, the photographic film was dried in a drying chamber with gentle air circulation at approximately 90° F. for approximately 20 minutes. The silver remaining in the film was measured by X-ray fluorescence. The silver removed from the D-min areas of the film by each fixer in the specified time, and the silver remaining in the film after fixing for the specified time is given in Table I.

TABLE I

| Fixer | Category | Time in Fixer, sec | Silver Removed from Film, g/m$^2$ | Re-maining in Film, g/m$^2$ | Time Required in Fixer Bath to Completely Fix the Film, sec |
|---|---|---|---|---|---|
| 1 | comparative | 100 | 7.456 | 0.636 | 123 |
| 2 | comparative | 100 | 0.118 | 7.973 | >1800 |
| 3 | inventive | 100 | 8.064 | 0.028 | 100 |
| 4 | inventive | 100 | 7.780 | 0.312 | 115 |
| 5 | inventive | 100 | 7.875 | 0.217 | 112 |
| 6 | comparative | 50 | 7.989 | 0.103 | 55 |
| 2 | comparative | 50 | 0.075 | 8.016 | >1800 |
| 7 | comparative | 50 | 7.968 | 0.124 | 55 |

The results of Table I show that the thioether compound 3 is very ineffective by itself in removing silver halide from the photographic material. In addition, the thioether compound 3 has no effect on the rate of desilvering (fixing) by the ammonium thiosulfate fixer when iodide is initially absent from the fixer. However, when added to a fixer containing no ammonium ion, compounds 3, 8, and 13 dramatically increase the rate of silver halide removal by the fixer. The increase in removal rate for Fixer 3 is greater than the expected increase obtained by adding the rates for Fixers 1 and 2. The data demonstrate that compounds 3, 8, and 13 unexpectedly increase the rate of silver halide removal for the fixer with no ammonium ion.

EXAMPLE 2

A silver halide color negative film (KODACOLOR GOLD 400 Film), in the form of strips that were 305 mm long and 35 mm wide, was given a suitable exposure to light and then processed by contacting the strips sequentially with processing solutions as follows:

| Process Step | Process Time, sec | Process Temp, °F. | Process Solution Volume, L | Agitation Type[a] |
|---|---|---|---|---|
| Color Development | 195 | 100 | 1 | 1 |
| Bleaching | 260 | 100 | 1 | 2 |
| Water Wash | 65 | 100 | 1 | 3 |
| Fixing | b) | 100 | 1 | 2 |
| Water Wash | 195 | 100 | 1 | 3 |
| Stabilization | 65 | 100 | 1 | 4 |

[a]The type of agitation used in the processing solutions is as follows:

1) the solution was agitated by the intermittent introduction of nitrogen gas bubbles through a perforated flat plate at the bottom of the solution tank. The bubbles were introduced for a 2 second interval once every 10 seconds.

2) the solution was continuously agitated by a constant flow of air bubbles through a perforated flat plate at the bottom of the solution tank.

3) the solution was agitated by the constant flow of fresh water into the bottom of the tank, with the overflow going to a drain.

4) the solution was quiescent, and received no agitation.

b) The film was fixed for varying lengths of time to determine the speed of silver halide removal and the time required for complete fixing of the film in the fixer baths. The film contained 8.479 g/m$^2$ of silver halide to be fixed, and 0.470 g/m$^2$ of iodide (4.72 mole percent based on silver).

The compositions of the color developer, bleach, and stabilizer used in processing are the same as for EXAMPLE 1. The formulae for the fixer baths are given in the table below.

Seven fixer baths were used, the contents of which are shown in the table below. Fixers 1, 3, 5, and 7 contained 0.827M sodium thiosulfate and 0.18M sodium sulfite at pH 6.5. The fixer baths contained no ammonium ion. Fixer 1 contained no thioether compound, and fixers 3, 5, and 7 contained the thioether compounds 24, 2, and 16, respectively, as indicated in the Table. Fixers 2, 4, and 6 contained only the thioether compounds 24, 2, and 16, respectively. The fixers contained no iodide at the beginning of fixing.

| Fixer | Thioether Compound | Sodium Thiosulfate M | Sodium Sulfite M | Thioether Concentration M | Ammonium Ion M | pH |
|---|---|---|---|---|---|---|
| | $CH_3SCH_2CH_2CH(NH_2)CO_2H$ | | | | 24 | |
| | $HOCH_2CH_2SCH_2CH_2OH$ | | | | 2 | |
| | $CH_3SCH_2CH_2CH_2NH_2$ | | | | 16 | |
| 1 | — | 0.827 | 0.18 | — | 0 | 6.5 |
| 2 | 24 | — | — | 0.1 | 0 | 6.5 |
| 3 | 24 | 0.827 | 0.18 | 0.1 | 0 | 6.5 |
| 4 | 2 | — | — | 0.2 | 0 | 6.5 |
| 5 | 2 | 0.827 | 0.18 | 0.2 | 0 | 6.5 |
| 6 | 16 | — | — | 0.01 | 0 | 6.5 |
| 7 | 16 | 0.827 | 0.18 | 0.01 | 0 | 6.5 |

After processing, the photographic film was dried in a drying chamber with gentle air circulation at approximately 90° F. for approximately 20 minutes. The silver remaining in the film was measured by X-ray fluorescence. The silver removed from the D-min areas of the film by each fixer in the specified time, and the silver remaining in the film after fixing for the specified time is given in Table II.

TABLE II

| Fixer | Category | Time in Fixer, sec | Silver Removed from Film, g/m² | Silver Remaining in Film, g/m² | Time Required in Fixer Bath to Completely Fix the Film, sec |
|---|---|---|---|---|---|
| 1 | comparative | 120 | 7.704 | 0.775 | >170 |
| 2 | comparative | 120 | 0.054 | 8.425 | >1800 |
| 3 | inventive | 120 | 8.275 | 0.204 | 130 |
| 1 | comparative | 120 | 7.704 | 0.775 | >170 |
| 4 | comparative | 120 | 0.000 | 8.479 | >1800 |
| 5 | inventive | 120 | 7.941 | 0.538 | 160 |
| 1 | comparative | 60 | 5.337 | 3.142 | >170 |
| 6 | comparative | 60 | 0.097 | 8.382 | >1800 |
| 7 | inventive | 60 | 7.338 | 1.141 | 120 |

The increases in removal rate for Fixers 3, 5, and 7 are greater than the expected increases obtained by adding the rates for Fixers 1 and 2, Fixers 1 and 4, and Fixers 1 and 6, respectively. Thus, compounds 24, 2, and 16 unexpectedly increase the rate of silver halide removal for the fixer with no ammonium ion.

EXAMPLE 3

A silver halide color negative motion picture film (EASTMAN EXR 5296 Film), in the form of strips that were 305 mm long and 35 mm wide, was given a suitable exposure to light and then processed by contacting the strips sequentially with processing solutions as follows:

| Process Step | Process Time, sec | Process Temp, °F. | Process Solution Volume, L | Agitation Type[a)] |
|---|---|---|---|---|
| Prebath | 15 | 106 | 8 | 4 |
| Water Wash | 15 | 102 | 8 | 3 |
| Color Development | 195 | 106 | 8 | 1 |
| Stop Bath | 30 | 106 | 8 | 2 |
| Water Wash | 30 | 102 | 8 | 3 |
| Bleaching | 180 | 106 | 8 | 2 |
| Water Wash | 60 | 102 | 8 | 2 |

-continued

| Process Step | Process Time, sec | Process Temp, °F. | Process Solution Volume, L | Agitation Type[a)] |
|---|---|---|---|---|
| Fixing | b) | 106 | 8 | 2 |
| Water Wash | 120 | 102 | 8 | 3 |
| Stabilization | 10 | 106 | 8 | 4 |

[a)]The type of agitation usec in the processing solutions was as follows
1) the solution was agitated by the intermittent introduction of nitrogen gas bubbles through a perforated flat plate at the bottom of the solution tank. The bubbles were introduced for a 1 second interval once every 3 seconds.
2) the solution was continuously agitated by a constant flow of air bubbles through a perforated flat plate at the bottom of the solution tank.
3) the solution was agitated by the constant flow of fresh water into the bottom of the tank, with the overflow going to a drain.
4) the solution was quiescent, and received no agitation.
b) The film was fixed for varying lengths of time to determine the speed of silver halide removal and the time required for complete fixing of the film in the fixer baths. The film contained 8.821 g/m² of silver halide to be fixed, and 0.459 g/m² of iodide (4.43 mole percent based on silver).

The composition of each processing solution (each was an aqueous solution) was as follows:

| Component | Concentration |
|---|---|
| Prebath: | |
| Aminotris (methylenephosphonic acid) pentasodium salt (40% solution) | 1.0 mL/L |
| Sodium sulfate | 100 g/L |
| Sodium bicarbonate | 8.5 g/L |
| Sodium carbonate, monohydrate | 8.0 g/L |
| pH | 9.3 |
| Color Developer: | |
| Aminotris (methylenephosphonic acid) pentasodium salt (40% solution) | 2.0 mL/L |
| Sodium carbonate, monohydrate | 30.00 g/L |
| Sodium bicarbonate | 2.75 g/L |
| Sodium sulfite | 2.00 g/L |
| Sodium bromide | 1.2 g/L |
| 3,5-dinitrobenzoic acid | 0.22 g/L |
| 4-(N-ethyl-N-(β-methanesulfonamidoethyl)-amino-2-methylanaline sesquisulfate monohydrate | 4.00 g/L |
| Sulfuric acid | 0.17 mL/L |
| pH | 10.2 |
| Stop Bath: | |
| Sulfuric acid | 10.0 mL/L |
| Bleach: | |
| Potassium ferricyanide | 50.0 g/L |
| Sodium bromide | 17.0 g/L |
| pH | 6.5–7.0 |
| Fixers: | |

The formula for the fixer baths are given in the table below.

| Stabilization Solution: | |
|---|---|
| PHOTO-FLO 200 solution (manufactured by Eastman Kodak Company) | 5.0 mL/L |

Two fixer baths were compared, the contents of which are shown in the table below. The fixers contained 0.97M total thiosulfate and 0.168M total bisulfite/sulfite at pH 6.5. Fixer 2 contained the thioether compound 3, above, in addition to thiosulfate. The fixers contained no ammonium ion, and no iodide at the beginning of fixing.

| Fixer | Sodium Thiosilfate M | Sodium Sulfite M | Compound 3 M | Aminotris (methylenephosphonic acid) pentasodium salt (40% solution), mL/L |
|---|---|---|---|---|
| 1 | 0.97 | 0.168 | — | 2.0 |
| 2 | 0.97 | 0.168 | 0.01 | 2.0 |

After processing, the photographic film was dried in a drying chamber with gentle air circulation at approximately 90° F. for approximately 20 minutes. The silver remaining in the film was measured by X-ray fluorescence. The silver removed from the D-min area of the film by each fixer in the specified time, and the silver remaining in the film after fixing for the specified time is given in Table III.

TABLE III

| Fixer | Category | Time in Fixer, sec | Silver Removed from Film, g/m$^2$ | Silver Re-maining in Film, g/m$^2$ | Time Required in Fixer Bath to Completely Fix the Film, sec |
|---|---|---|---|---|---|
| 1 | comparative | 60 | 8.404 | 0.417 | 75 |
| 2 | inventive | 60 | 8.737 | 0.084 | 65 |

The results of Table III show that the thioether compound 3 is very effective, when added to a fixer containing no ammonium ion, at increasing the rate of silver halide removal by the fixer.

EXAMPLE 4

A silver halide panchromatic black-and-white negative film (KODAK T-MAX 100 Film), in the form of strips that were 305 mm long and 35 mm wide, was given a suitable exposure to light and then processed by contacting the strips sequentially with processing solutions as follows:

| Process Step | Process Time, sec | Process Temp, °F. | Process Solution Volume, L | Agitation Type[a)] |
|---|---|---|---|---|
| Development | 360 | 75 | 8 | 1 |
| Water Wash | 60 | 70 | 8 | 3 |
| Fixing | b) | 75 | 8 | 2 |
| Water Wash | 300 | 70 | 8 | 3 |
| Stabilization | 60 | 75 | 8 | 4 |

[a)]The type of agitation used in the processing solutions was follows:
1) the solution was agitated by the intermittent introduction of nitrogen gas bubbles through a perforated flat plate at the bottom of the solution tank. The bubbles were introduced for a 2 second interval once every 10 seconds.
2) the solution was continuously agitated by a constant flow of air bubbles through a perforated flat plate at the bottom of the solution tank.
3) the solution was agitated by the constant flow of fresh water into the bottom of the tank, with the overflow going to a drain.
4) the solution was quiescent, and received no agitation.
b) The film was fixed for varying lengths of time to determine the speed of silver halide removal and the time required for complete fixing of the film in the fixer baths. The film contained 3.334 g/m$^2$ of silver halide to be fixed in the areas with a minimum of developed silver. The film also contained 0.473 g/m$^2$ of iodide (12.1 mole percent based on silver).

The composition of each processing solution (each was an aqueous solution) was as follows:

| Component | Concentration |
|---|---|
| Developer: | |
| Sodium sulfite | 100.0 g/l |
| Hydroquinone | 5.0 g/L |
| 4-(N-methyl)aminophenol sulfate | 2.0 g/L |
| Sodium Borate, 10-hydrate | 2.0 g/L |

Fixers:

The ingredients that differentiate the fixer baths from each other are given in the table below. In addition to those ingredients, the fixers also each contained the following components (with the exception of Fixer 2 which contained only the thioether compound, 3, above). The pH was adjusted to 4.4 for each fixer with 50% sodium hydroxide.

| | |
|---|---|
| Aluminium sulfate, 18-hydrate | 12.7 g/L |
| Sulfuric acid | 4.0 g/L |
| Acetic acid | 24.4 g/L |
| Sodium Borate, 10-hydrate | 11.2 g/L |
| Stabilization Solution: | |
| PHOTO-FLO 200 solution (manufactured by Eastman Kodak Company) | 5.0 mL/L |

Five fixer baths were used, the additional contents of which are shown in the table below. The thiosulfate fixers 1, 3, 4, and 5 contained 0.94M total thiosulfate and 0.147M total bisulfite/sulfite at pH 4.4. The fixer baths differed in the amounts of ammonium ion that they contained. Fixers 1 and 3 contained no ammonium ion and Fixers 4 and 5 contained 2.05M ammonium ion. Fixer 2 contained only the thioether compound, 3, above. Fixers 3 and 5 contained the thioether compound 3 in addition to thiosulfate. The fixers contained no iodide at the beginning of fixing.

| Fixer | Ammonium Thiosulfate M | Sodium Thiosulfate M | $NH_4^+$ Sulfite M | Sodium Sulfite M | Compound 3 M | $NH_4^+$ M | pH |
|---|---|---|---|---|---|---|---|
| 1 | — | 0.94 | — | 0.147 | — | 0 | 4.4 |
| 2 | — | — | — | — | 0.01 | 0 | 4.4 |
| 3 | — | 0.94 | — | 0.147 | 0.01 | 0 | 4.4 |
| 4 | 0.94 | — | 0.085 | 0.062 | — | 2.05 | 4.4 |
| 5 | 0.94 | — | 0.085 | 0.062 | 0.01 | 2.05 | 4.4 |

After processing, the photographic film was dried in a drying chamber with gentle air circulation at approximately 90° F. for approximately 20 minutes. The silver remaining in the minimum density area of the film was measured by X-ray fluorescence. The silver removed from the D-min areas of the film by each fixer in the specified time, and the silver remaining in the film after fixing for the specified time is given in Table IV. The residual fog level of silver in the film was about 0.055 g/m$^2$.

TABLE IV

| Fixer | Category | Time in Fixer, sec | Silver Removed from Film, g/m$^2$ | Silver Remaining in Film, g/m$^2$ | Time Required in Fixer Bath to Completely Fix the Film, sec |
|---|---|---|---|---|---|
| 1 | comparative | 110 | 3.060 | 0.329 | 140 |
| 2 | comparative | 110 | 0 | 3.389 | >1800 |
| 3 | inventive | 110 | 3.252 | 0.137 | 120 |
| 4 | comparative | 40 | 3.222 | 0.167 | 45 |
| 2 | comparative | 40 | 0 | 3.389 | >1800 |
| 5 | comparative | 40 | 3.194 | 0.195 | 45 |

The results of Table IV show that the thioether compound 3 is ineffective by itself in removing silver halide from the photographic material. In addition, the thioether compound 3 has no effect on the rate of desilvering (fixing) by the ammonium thiosulfate fixer when iodide is initially absent from the fixer. However, when added to a fixer containing no ammonium ion, compound 3 dramatically increases the rate of silver halide removal by the fixer.

EXAMPLE 5

A silver halide spectrally sensitized black-and-white laser scanning film (KODAK EKTASCAN HN Film), in the form of strips that were 305 mm long and 35 mm wide, was given a suitable exposure to light and then processed by contacting the strips sequentially with processing solutions as follows:

| Process Step | Process Time, sec | Process Temp, °F. | Process Solution Volume, L | Agitation Type[a] |
|---|---|---|---|---|
| Development | 30 | 100 | 8 | 1 |
| Fixing | b) | 100 | 8 | 2 |
| Water Wash | 180 | 95 | 8 | 3 |
| Stabilization | 60 | 100 | 8 | 4 |

[a]The type of agitation used in the processing solutions is as follows:
1) the solution was agitated by the intermittent introduction of nitrogen gas bubbles through a perforated flat plate at the bottom of the solution tank. The bubbles were introduced for a 2 second interval once every 10 seconds.
2) the solution was continuously agitated by a constant flow of air bubbles through a perforated flat plate at the bottom of the solution tank.

-continued

| Process Step | Process Time, sec | Process Temp, °F. | Process Solution Volume, L | Agitation Type[a] |
|---|---|---|---|---|

3) the solution was agitated by the constant flow of fresh water into the bottom of the tank, with the overflow going to a drain.
4) the solution was quiescent, and received no agitation.
b) The film was fixed for varying lengths of time to determine the speed of silver halide removal and the time required for complete fixing of the film in the fixer baths. The film contained 3.465 g/m$^2$ of silver halide to be fixed in the areas with a minimum of developed silver. The film also contained 0.122 g/m$^2$ of iodide (2.99 mole percent based on silver).

The composition of each processing solution (each was an aqueous solution) was as follows:

| Component | Concentration |
|---|---|
| Developer: | |
| Sodium sulfite | 72.0 g/L |
| Hydroquinone | 10.0 g/L |
| 4-(N-methyl)aminophenol sulfate | 5.0 g/L |
| Sodium metaborate, 8-hydrate | 48.0 g/L |
| Potassium bromide | 5.0 g/L |
| Potassium iodide | 0.01 g/L |
| Sodium hydroxide | 3.5 g/L |

Fixers:

The ingredients that differentiate the fixer baths from each other are given in the table below. In addition to those ingredients, the fixers also each contained the following components. The pH was adjusted to 4.1 for each fixer with 50% sodium hydroxide.

| | |
|---|---|
| Aluminum sulfate, 18-hydrate | 11.3 g/L |
| Acetic acid | 20.7 g/L |
| Sodium gluconate | 3.23 g/L |
| Sodium hydroxide | 2.0 g/L (approx) |
| Stabilization Solution: | |
| PHOTO-FLO 200 solution (manufactured by Eastman Kodak Company) | 5.0 mL/L |

Two fixer baths were compared, the additional contents of which are shown in the table below. The fixers contained 1.135M total thiosulfate and 0.134M total bisulfite/sulfite at pH 4.1. Fixer 2 contained the thioether compound 3, above, in addition to thiosulfate. The fixers contained no ammonium ion, and contained no iodide ion at the beginning of fixing.

| Fixer | Sodium Thiosulfate M | Sodium Sulfite M | Compound 3 M |
|---|---|---|---|
| 1 | 1.135 | 0.134 | — |
| 2 | 1.135 | 0.134 | 0.01 |

After processing, the photographic film was dried in a drying chamber with gentle air circulation at approximately 90° F. for approximately 20 minutes. The silver remaining in the minimum density area of the film was measured by X-ray fluorescence. The silver removed from the D-min areas of the film by each fixer in the specified time, and the silver remaining in the film after fixing for the specified time is given in Table V. The residual fog level of silver in the film after processing was about 0.140 g/m$^2$ of silver.

TABLE V

| Fixer | Category | Time in Fixer, sec | Silver Removed from Film, g/m$^2$ | Re-maining in Film, g/m$^2$ | Time Required in Fixer Bath to Completely Fix the Film, sec |
|---|---|---|---|---|---|
| 1 | comparative | 10 | 2.846 | 0.759 | 16 |
| 2 | inventive | 10 | 3.328 | 0.277 | 11 |

The results of Table V show that the thioether compound 3 is very effective, when added to a fixer containing no ammonium ion, at increasing the rate of silver halide removal by the fixer.

EXAMPLE 6

A silver halide color negative film (KODACOLOR GOLD 200 Film), in the form of strips that were 305 mm long and 35 mm wide, was given a suitable exposure to light and then processed according to the same process described in EXAMPLE 1, substituting fixer baths with varying amounts of ammonium ion into the process. The film contained 7.941 g/m$^2$ of silver halide to be fixed, and 0.753 g/m$^2$ of iodide (8.06 mole percent based on silver).

Five fixer baths were used, the contents of which are shown in the table below. The thiosulfate fixers 1, 3, 4, and 5 contained 0.825M total thiosulfate and 0.2M total bisulfite/sulfite at pH 6.5. The fixer baths differed in the amounts of ammonium ion that they contained. Fixers 1 and 3 contained 0.9M ammonium ion and Fixers 4 and 5 contained 1.35M ammonium ion. Fixer 2 contained only the thioether compound, 3, above. Fixers 3 and 5 contained the thioether compound 3 in addition to thiosulfate.

| Fixer | Ammonium Thiosulfate M | Sodium Thiosulfate M | $NH_4^+$ Sulfite M | Sodium Sulfite M | Compound 3 M | $NH_4^+$ M | pH |
|---|---|---|---|---|---|---|---|
| 1 | 0.412 | 0.413 | 0.0375 | 0.1625 | — | 0.9 | 6.5 |
| 2 | — | — | — | — | 0.01 | 0 | 6.5 |
| 3 | 0.412 | 0.413 | 0.0375 | 0.1625 | 0.01 | 0.9 | 6.5 |
| 4 | 0.619 | 0.206 | 0.0563 | 0.1437 | — | 1.35 | 6.5 |
| 5 | 0.619 | 0.206 | 0.0563 | 0.1437 | 0.01 | 1.35 | 6.5 |

After processing, the photographic film was dried in a drying chamber with gentle air circulation at approximately 90° F. for approximately 20 minutes. The silver remaining in the film was measured by X-ray fluorescence. The silver removed from the D-min areas of the film by each fixer in the specified time, and the silver remaining in the film after fixing for the specified time is given in Table VI.

TABLE VI

| Fixer | Category | Time in Fixer, sec | Silver Removed from Film, g/m$^2$ | Re-maining in Film, g/m$^2$ | Time Required in Fixer Bath to Completely Fix the Film, sec |
|---|---|---|---|---|---|
| 1 | comparative | 50 | 6.899 | 1.042 | 75 |
| 2 | comparative | 50 | 0.075 | 7.866 | >1800 |
| 3 | inventive | 50 | 7.519 | 0.422 | 70 |
| 4 | comparative | 45 | 7.538 | 0.403 | 55 |
| 2 | comparative | 45 | 0.075 | 7.866 | >1800 |
| 5 | inventive | 45 | 7.634 | 0.307 | 55 |

The results of Table VI show that the thioether compound 3 is very ineffective by itself in removing silver halide from the photographic material. When present in a fixer containing 0.9M ammonium ion, compound 3 significantly increases the rate of silver halide removal by the fixer. The increase in removal rate for Fixer 3 is greater than the expected increase from adding the rates for Fixers 1 and 2. When present in a fixer with 1.35M ammonium ion, compound 3 is able to improve the silver removal rate to a small extent even though iodide is not initially present in the fixer. This is still greater than expected by a small margin. Thus, compound 3 unexpectedly increases the rate of silver halide removal for fixers with up to about 1.35M ammonium ion.

EXAMPLE 7

A silver halide color negative film (KODACOLOR GOLD 200 Film), in the form of strips that were 305 mm long and 35 mm wide, was given a suitable exposure to light and then processed according to the same process described in EXAMPLE 1, substituting fixer baths with varying amounts of ammonium thiosulfate into the process. The film contained 7.941 g/m$^2$ of silver halide to be fixed, and 0.753 g/m$^2$ of iodide (8.06 mole percent based on silver).

Nine fixer baths were used, the contents of which are shown in the table below. The fixer baths were all at pH 6.5. The fixer baths differed in the amounts of ammonium thiosulfate and ammonium ion that they contained, and in the presence or absence of the thioether compound, 3. Fixers 1, 3, 5, and 7 contained ammonium thiosulfate and no thioether compound, and fixers 2, 4, 6, and 8 contained the compound, 3, in addition to ammonium thiosulfate. Fixer 9 contained only the compound, 3. The fixers contained no iodide at the beginning of fixing.

| Fixer | Ammonium Thiosulfate M | Ammonium Sulfite M | Sodium Sulfite M | Compound 3 M | Ammonium Ion M | pH |
|---|---|---|---|---|---|---|
| 1 | 0.275 | 0.025 | 0.0417 | — | 0.6 | 6.5 |
| 2 | 0.275 | 0.025 | 0.0417 | 0.01 | 0.6 | 6.5 |
| 3 | 0.413 | 0.0375 | 0.0625 | — | 0.9 | 6.5 |
| 4 | 0.413 | 0.0375 | 0.0625 | 0.01 | 0.9 | 6.5 |
| 5 | 0.550 | 0.050 | 0.0833 | — | 1.2 | 6.5 |
| 6 | 0.550 | 0.050 | 0.0833 | 0.01 | 1.2 | 6.5 |
| 7 | 0.619 | 0.056 | 0.0938 | — | 1.35 | 6.5 |
| 8 | 0.619 | 0.056 | 0.0938 | 0.01 | 1.35 | 6.5 |
| 9 | — | — | — | 0.01 | 0 | 6.5 |

After processing, the photographic film was dried in a drying chamber with gentle air circulation at approximately 90° F. for approximately 20 minutes. The silver remaining in the D-min areas of the film was measured by X-ray fluorescence. The silver removed from the film by each fixer in the specified time, and the silver remaining in the film after fixing for the specified time is given in Table VII.

TABLE VII

| Fixer | Category | Time in Fixer, sec | Silver Removed from Film, g/m² | Remaining in Film, g/m² | Time Required in Fixer Bath to Completely Fix the Film, sec |
|---|---|---|---|---|---|
| 1 | comparative | 168 | 7.298 | 0.643 | 196 |
| 2 | inventive | 168 | 7.749 | 0.192 | 185 |
| 3 | comparative | 110 | 7.612 | 0.329 | 130 |
| 4 | inventive | 110 | 7.848 | 0.093 | 112 |
| 5 | comparative | 64 | 7.314 | 0.627 | 86 |
| 6 | inventive | 64 | 7.627 | 0.314 | 80 |
| 7 | comparative | 54 | 7.466 | 0.475 | 72 |
| 8 | inventive | 54 | 7.621 | 0.320 | 72 |
| 9 | comparative | 140 | 0.118 | 7.823 | >1800 |

The results of Table VII show that the thioether compound 3 is very ineffective by itself in removing silver halide from the photographic material. When present in a fixer containing less than about 1.35M ammonium ion, compound 3 significantly increases the rate of silver halide removal by the fixer. The increase in removal rate for Fixers 2, 4, 6, and 8 is greater than the expected increase from adding the rates for Fixers 1, 3, 5, and 7 with the rate for Fixer 9. When present in a fixer with 1.35M ammonium ion, compound 3 is able to improve the silver removal rate to a small extent. This is still greater than expected by a small margin. Thus, compound 3 unexpectedly increases the rate of silver halide removal for fixers with up to about 1.35M ammonium ion.

EXAMPLE 8

A silver halide color negative film (KODACOLOR GOLD 200 Film), in the form of strips that were 305 mm long and 35 mm wide, was given a suitable exposure to light and then processed according to the same process described in EXAMPLE 1, substituting fixer baths with varying amounts of iodide into the process. The film contained 7.941 g/m² of silver halide to be fixed, and 0.753 g/m² of iodide (8.06 mole percent based on silver).

Seven fixer baths were used, the contents of which are shown in the table below. The fixer baths were all at pH 6.5. All fixers except fixer 7 contained 0.825M ammonium thiosulfate. They differed in the presence or absence of silver bromide, iodide, and compound 3. Fixer 7 contained only compound 3.

| Fixer | Ammonium Thiosulfate M | $NH_4^+$ Sulfite M | Sodium Sulfite M | Compound 3 M | $NH_4^+$ Iodide M | Silver Bromide M | $NH_4^+$ M |
|---|---|---|---|---|---|---|---|
| 1 | 0.825 | 0.075 | 0.125 | — | — | 0.1 | 1.805 |
| 2 | 0.825 | 0.075 | 0.125 | 0.01 | — | 0.1 | 1.805 |
| 3 | 0.825 | 0.075 | 0.125 | — | 0.005 | — | 1.805 |
| 4 | 0.825 | 0.075 | 0.125 | 0.01 | 0.005 | — | 1.805 |
| 5 | 0.825 | 0.075 | 0.125 | — | 0.005 | 0.1 | 1.805 |
| 6 | 0.825 | 0.075 | 0.125 | 0.01 | 0.005 | 0.1 | 1.805 |
| 7 | — | — | — | 0.01 | — | — | — |

After processing, the photographic film was dried in a drying chamber with gentle air circulation at approximately 90° F. for approximately 20 minutes. The silver remaining in the film was measured by X-ray fluorescence. The silver removed from the D-min areas of the film by each fixer in the specified time, and the silver remaining in the film after fixing for the specified time is given in Table VIII.

TABLE VIII

| Fixer | Category | Time in Fixer, sec | Silver Removed from Film, g/m² | Remaining in Film, g/m² | Time Required in Fixer Bath to Completely Fix the Film, sec |
|---|---|---|---|---|---|
| 1 | comparative | 50 | 7.560 | 0.381 | 41 |
| 7 | comparative | 50 | 0.075 | 7.866 | >1800 |
| 2 | comparative | 50 | 7.578 | 0.363 | 41 |
| 3 | comparative | 30 | 6.265 | 1.676 | 69 |
| 7 | comparative | 30 | 0.022 | 7.919 | >1800 |
| 4 | inventive | 30 | 6.650 | 1.291 | 68 |
| 5 | comparative | 50 | 6.117 | 1.824 | 142 |
| 7 | comparative | 50 | 0.075 | 7.866 | >1800 |
| 6 | inventive | 50 | 6.673 | 1.268 | 130 |
| 5 | comparative | 100 | 7.476 | 0.465 | 142 |
| 7 | comparative | 100 | 0.118 | 7.823 | >1800 |
| 6 | inventive | 100 | 7.627 | 0.314 | 130 |

The results of Table VIII show that the thioether compound 3 is very ineffective by itself in removing silver halide from the photographic material. When present in a fixer containing more than about 1.35M ammonium ion and no iodide at the beginning of fixing, compound 3 has essentially no effect on the silver removal rate, even when silver bromide is present in the fixer. When present in a fixer containing more than about 1.35M ammonium ion and only 0.005M iodide, compound 3 significantly increases the rate of silver halide removal by the fixer. With silver present in the fixer in addition to iodide, the improvement in silver removal rate when compound 3 is present is even more noticeable. The increase in removal rate for Fixers 4 and 6 is greater than the expected increase from adding the rates for Fixers 3 and 5 with the rate for Fixer 7. Thus, compound 3 unexpectedly increases the rate of silver halide removal for thiosulfate fixers containing iodide.

EXAMPLE 9

As further illustration of the ability of thioether-containing compounds to improve the fixing rates of silver halide emulsions, particularly under the conditions of reduced fixer efficacy when the ammonium content of the fixer is lowered even to the point of its complete elimination, a series of five different silver halide photographic coatings was prepared. The series comprised silver bromide and silver bromoiodide emulsions of varying iodide content and varying morphologies. The photographic recording materials were prepared by coating the following layers, in order, on a cellulose acetate film support.

TABLE IX

Elements A–E

| | |
|---|---|
| Layer 1 | Silver Halide Emulsion Layer - comprising one of the five silver bromide or silver bromoiodide emulsions characterized in Table IX at approximately 4.3 g/m$^2$ of silver, and gelatin at 15.1 g/m$^2$ . |
| Layer 2 | Protective Overcoat - comprising gelatin at 1.08 g/m$^2$ with 1.75% (by weight to total gelatin in the coating) of gelatin hardener, bis(vinylsulfonylmethyl) ether. |

| Element | Silver coverage, g/m$^2$ | Silver Halide | Emulsion Iodide Content (mole % of silver) | Grain Morphology | Grain Diameter[a], micron | Grain Thickness, micron |
|---|---|---|---|---|---|---|
| A | 4.390 | AgBr | 0 | octahedral | 1.09 | — |
| B | 4.315 | AgBr | 0 | tabular | 2.26 | 0.094 |
| C | 3.788 | AgBrI | 0.15 | tabular | 1.8 | 0.133 |
| D | 4.315 | AgBrI | 1.66 | spherical | 1.2 | — |
| E | 4.358 | AgBrI | 2.50 | tabular | 1.52 | 1.184 |

[a]The grain diameter is measured from electron micrographs of the emulsions. For octahedral or spherical emulsions the diameter is expressed as the equivalent spherical diameter for the grain. For tabular emulsions the diameter is expressed as the equivalent circular diameter for the grain.

The coatings, in the form of strips that were 305 mm long and 35 mm wide, were processed as indicated below:

| Process Step | Process Time, sec | Process Temp, °F. | Process Solution Volume, L | Agitation Type[a] |
|---|---|---|---|---|
| Tap Water Presoak | 615 | 95 | 8 | 1 |
| Fixing (time series) | 3–4 sec intervals | 100 | 8 | 2 |
| Water Wash | 180 | 95 | 8 | 1 |
| Stabilization | 60 | 100 | 8 | 3 |

[a]The type of agitation used in the processing solutions is as follows:
1) the solution was agitated by the constant flow of fresh water into the bottom of the tank, with the overflow going to a drain.
2) the solution was continuously agitated by a constant flow of air bubbles through a perforated flat plate at the bottom of the solution tank.
3) the solution was quiescent, and received no agitation.

In the fixing step, two fixer baths were used, the contents of which are shown in the table below. The fixer baths were at pH 6.5. Both fixers contained 0.66M sodium thiosulfate and 0.16M sodium sulfite. Fixer 2 contained compound 3 in addition to the other fixer ingredients.

| Fixer | Sodium Thiosulfate M | Sodium Sulfite M | Compound 3 M | pH |
|---|---|---|---|---|
| 1 | 0.66 | 0.16 | — | 6.5 |
| 2 | 0.66 | 0.16 | 0.01 | 6.5 |

Stabilizer Bath:

The stabilizer processing solution contained 5 mL of PHOTO-FLO 200 solution (manufactured by Eastman Kodak Company) per liter of tap water.

During fixing, samples of each coating were removed at controlled time intervals (3–4 second intervals depending on the rate of fixing), then washed, stabilized, and dried. The silver remaining in the film was measured by X-ray fluorescence. The silver removed from the film by each fixer in the specified time, and the silver remaining in the film after fixing for the specified time is given in Table X.

TABLE X

| Element | Fixer | Category | Time in Fixer, sec | Silver Removed from Film, $g/m^2$ | Time Required in Fixer Bath to Completely Fix the Film, sec |
|---|---|---|---|---|---|
| A | 1 | comparative | 16 | 3.788 | 20 |
| A | 2 | comparative | 16 | 3.820 | 20 |
| B | 1 | comparative | 16 | 3.970 | 18.5 |
| B | 2 | comparative | 16 | 3.970 | 18.5 |
| C | 1 | comparative | 12 | 3.163 | 16 |
| C | 2 | comparative | 12 | 3.196 | 16 |
| D | 1 | comparative | 20 | 3.379 | 32 |
| D | 2 | inventive | 20 | 3.884 | 26 |
| E | 1 | comparative | 24 | 3.422 | 38 |
| E | 2 | inventive | 24 | 3.831 | 32 |

The results of Table X show that the thioether compound 3 is not effective at accelerating fixing rates of emulsions with an iodide content of less than about 1 mole percent based on silver. However, for emulsions with an iodide content greater than about 1 mole percent, compound 3 is an effective accelerator of fixing rates.

The invention has been described in detail above with particular reference to preferred embodiments. A skilled practitioner, familiar with the above-detailed description, can make many substitutions and modifications without departing from the scope and the spirit of the appended claims.

We claim:

1. A process for fixing an exposed and developed silver halide-based color photographic material, said process comprising fixing said material with a fixer comprising thiosulfate and a fix rate-accelerating amount of a thioether compound, said process being characterized by being conducted:

a) in the presence of a fix rate-retarding amount of iodide, and b) in the substantial absence of an iron chelate bleaching agent;

wherein the ammonium concentration in said fixer is less than 0.9 mole per liter.

2. The process of claim 1 wherein said amount of iodide is present in said fixer in an amount of from 0.001 to 0.05M.

3. The process of claim 1 wherein said iodide is present in at least one iodide-containing silver halide emulsion in said photographic material, in an amount equal to or greater than 1.0 mole percent iodide, based on the amount of silver in said emulsion.

4. The process of claim 1 wherein the concentration of said thiosulfate is from 0.1 to 2 molar.

5. The process of claim 1 wherein said thioether compound is present in an amount of from $1\times10^{-4}$ to $5\times10^{-1}$ mole per liter.

6. The process of claim 5 wherein said thioether compound is present in an amount of from $1\times10^{-3}$ to $2\times10^{-1}$ mole per liter.

7. The process of claim 6 wherein said thioether compound is present in an amount of from $1\times10^{-2}$ to $2\times10^{-1}$ mole per liter.

8. The process of claim 1 being conducted at a temperature of from 10° C. to 50° C.

9. The process of claim 1 being conducted for a time of from 10 to 480 seconds.

10. The process of claim 1 wherein said thioether compound has the formula:

$$R_1—S—R_2$$

wherein $R_1$ and $R_2$ are (a) the same or different (b) selected from the class consisting of aromatic groups, and saturated and unsaturated aliphatic groups, having up to 30 carbon atoms, and (c) are separate or linked by a bond to form a non-aromatic ring.

11. The process of claim 10 wherein said thioether compound is substituted with an amine, ammonium, guanidine, or guanidinium group.

12. The process of claim 1 wherein said thioether compound has the formula:

$$R_1—S—R_3—S—R_2$$

wherein $R_1$ and $R_2$ are (a) the same or different (b) selected from the class consisting of aromatic groups, and saturated and unsaturated aliphatic groups, having up to 30 carbon atoms, and (c) are separate or linked by a bond to form a non-aromatic ring and $R_3$ is a bridging group having up to 10 carbon atoms and which separates the two sulfur atoms in the above formula by two carbon atoms.

13. A process for fixing an exposed and developed silver halide-based non-spectrally sensitized black-and-white photographic material;

said process comprising fixing said material with a fixer comprising thiosulfate and a fix rate accelerating amount of a thioether compound, said process being characterized by being conducted in the presence of a fix rate-retarding amount of iodide; wherein the ammonium concentration in said fixer is less than 0.9 mole per liter.

14. A fixer suitable for fixing exposed, and developed silver halide-based photographic material in the presence of a rate-retarding amount of iodide, said fixer comprising a thiosulfate and a thioether compound in an amount such that the rate of fixing with said fixer is greater than the sum of the rates achieved when said thioether compound and said thiosulfate are each used alone, in said amounts, with said rate-retarding amount of iodide, said fixer containing substantially no iron chelate bleaching agent and having an ammonium concentration less than 0.9M.

15. The fixer of claim 14 wherein the thiosulfate concentration is from 0.1 to 2 molar.

16. The fixer of claim 14 wherein the thioether compound is present in an amount of from $1\times10^{-4}$ to $5\times10^{-1}$ mole per liter.

17. The fixer of claim 14 wherein said thioether compound has the formula:

$$R_1—S—R_2$$

wherein $R_1$ and $R_2$ are (a) the same or different (b) selected from the class consisting of aromatic groups, and saturated and unsaturated aliphatic groups, having up to 30 carbon atoms, and (c) are separate or linked by a bond to form a non-aromatic ring.

18. The fixer of claim 17 wherein said thioether compound is substituted with an amine, ammonium, guanidine, or guanidinium group.

19. The fixer of claim 14 wherein said thioether compound has the formula:

$$R_1—S—R_3—S—R_2$$

wherein $R_1$ and $R_2$ are (a) the same or different (b) selected from the class consisting of aromatic groups, and saturated and unsaturated aliphatic groups, having up to 30 carbon atoms, and (c) are separate or linked by a bond to form a non-aromatic ring and $R_3$ is a bridging group having up to 10 carbon atoms and which separates the two sulfur atoms in the above formula by two carbon atoms.

20. The process of claim 1 wherein the ammonium ion concentration in said fixer is 0.6 mol/l or less.

21. The fixer of claim 14 wherein the ammonium ion concentration is 0.6 mol/l or less.

* * * * *